US005810624A

United States Patent [19]

Lamb

[11] Patent Number: 5,810,624

[45] Date of Patent: Sep. 22, 1998

[54] SUPPORT BLOCK FOR MULTIPLE ELECTRICAL CONNECTORS

[76] Inventor: Charles S. Lamb, 2054 N. 800 Rd., Eudora, Kans. 66025

[21] Appl. No.: 704,157

[22] Filed: Aug. 28, 1996

[51] Int. Cl.[6] ..... H01R 25/00

[52] U.S. Cl. ..... 439/652

[58] Field of Search ..... 439/639, 650, 439/651, 652, 653, 654, 701

[56] References Cited

U.S. PATENT DOCUMENTS

| | | | |
|---|---|---|---|
| 3,005,179 | 10/1961 | Holt | 439/652 |
| 3,018,350 | 1/1962 | Jensen | 439/652 |
| 3,985,415 | 10/1976 | Wolpert et al. | 439/270 |
| 4,705,342 | 11/1987 | Schwartz | 439/650 |
| 4,897,049 | 1/1990 | Miller et al. | 439/652 |
| 5,094,630 | 3/1992 | Jammet | 439/652 |

OTHER PUBLICATIONS

Sales literature of molded plastic Y Connectors by Olesen, exact publication date unknown, but at least one year prior to the filing of the present application.

Sales literature showing Rosco/SCI Pin connectors, exact publication date unknown, but at least one year prior to the filing of the present application.

Sales literature showing Proscenium Lighting Two–Fer and Three–Fer electrical splitting circuits, exact publication date unknown, but at least one year prior to the filing of the present application.

USITT S3–1996 Standard for Stage Pin Connectors by United States Institute for Theatre Technology, New York, NY, Draft Standard Nov., 1995; Copyright 1995.

*Primary Examiner*—Neil Abrams
*Assistant Examiner*—Katrina Davis
*Attorney, Agent, or Firm*—Litman, McMahon & Brown, L.L.C.

[57] ABSTRACT

A support block for supporting and interconnecting multiple electrical connectors to form a "two-fer" electrical circuit splitter includes a first portion with a first thickness forming a first surface for holding a male electrical plug and a second portion of a second thickness extending from the first portion and forming a second and a third surface for holding respective ones of a pair of female electrical plugs. An aperture is formed in the second portion and extends from the second to the third surface to allow electrical connections to be made between the pair of female plugs. Secure electrical connections can thus be made via cable passages of the male and the female plug, as well as between the two female plugs through the aperture positioned therebetween. A projection is formed on the block near the third surface which projection fits within and substantially covers the cable passage in the second female plug.

10 Claims, 2 Drawing Sheets

PRIOR ART

Fig. 3.
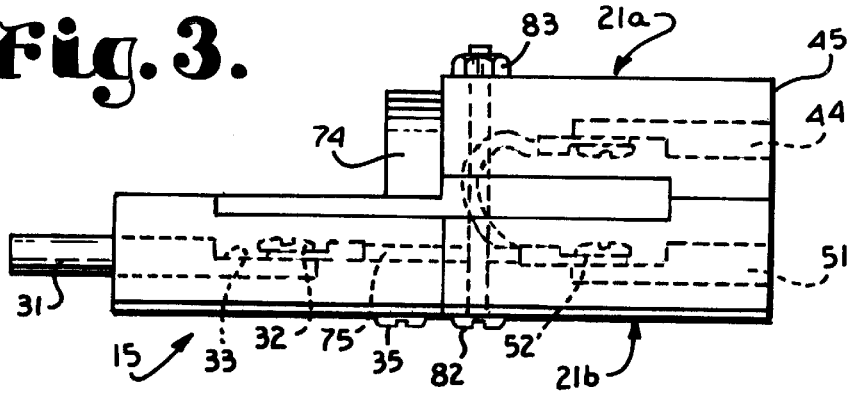
Fig. 5.
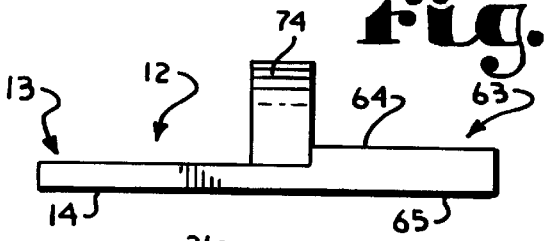
Fig. 6.
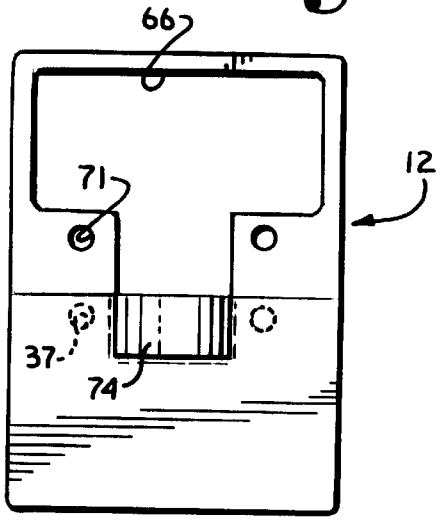
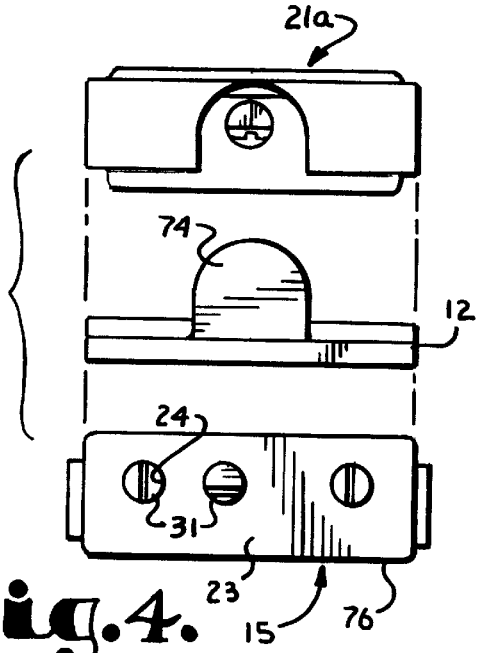
Fig. 4.

SUPPORT BLOCK FOR MULTIPLE ELECTRICAL CONNECTORS

BACKGROUND OF THE INVENTION

1. Field of the Invention

The present invention relates generally to a support block for multiple electrical connectors, and, more particularly, to a block which supports a single male and a pair of connected female electrical plugs in a compact and secure arrangement.

2. Description of the Related Art

Stage and theater productions, due to their great variety of set and prop designs, require a virtually endless variety of lighting and sound arrangements. Electrical cables for supplying power to the lights and sound systems are constantly being pulled around the stage, stepped on, run over by vehicles, etc., which places great stress on the cables themselves, and, in particular, to the plugs interconnecting the cables. A number of specialized plugs have been developed to withstand the rigors of stage and theater productions while reliably maintaining electrical connections.

A representative electrical plug is shown and described in U.S. Pat. No. 3,985,415 ("the '415 patent") to Wolpert et al., entitled LOCKING PLUG AND RECEPTACLE THEREFOR, which is hereby incorporated herein by reference. This plug, which is made by the Union Connector Company, Inc. of Roosevelt, N.Y., has become somewhat of a standard in the industry. The Wolpert plug is a three pronged rectangular male plug which mates with a corresponding three socket female plug. The center prong of the male plug includes a retractable hook controlled by a side mounted button. The hook engages an internal aperture in the center socket of the female plug to securely, but releasably, hold the plugs together.

It is typical in the industry to route a pair of cables in parallel off of a single feeder cable to serve, for example, two banks of stage lights. This arrangement, which is known as a "two-fer", typically uses a single male plug connected to a pair of female plugs, similar to those taught by Wolpert, via a pair of short cable lengths forming a "Y". These "two-fers" can be purchased off the shelf as molded plastic Y connections, or, more typically, can be rigged up on the set out of spare parts. However, the two-fers are subjected to the same rugged use and abuse as the plugs, but the two-fers are subject to twisting and bending motions and they do not have a solid housing to protect them. Accordingly, it is all too typical for these two-fers to fail from shorts or open circuits in the Y cable or from leads being pulled off of the plugs. This can be embarrassing at the least, depending upon when the failure occurs, and can also present a fire or electrical hazard as well.

It is clear then, that a need exists for a reliable, practical and inexpensive "two-fer" for branching electrical supply cables, particularly for theater and stage lighting and sound applications. The present invention addresses this problem.

SUMMARY OF THE INVENTION

The present invention comprises a support block for interconnecting multiple electrical connectors for accommodating the splitting of electrical power supply circuits in environments such as lighting and sound systems in stage and theatrical productions. The support block, which can be machined or molded of high impact plastic material such as a phenolic resin, includes a first portion with a first thickness forming a first surface for holding a male electrical plug. A second portion of a second thickness extends from the first portion and forms a second and a third surface for holding respective ones of a pair of female electrical plugs. An aperture is formed in the second portion and extends from the second to the third surface to allow electrical connections to be made between the pair of female plugs. Each of the first, second and third surfaces includes threaded bores positioned to accommodate screws extending through corresponding bores in the respective electrical plugs. The male plug is positioned end to end with one of the female plugs such that cable passages in the male and female plugs are aligned to form a channel. Secure electrical connections can thus be made through the channel between the male and the female plug, as well as between the two female plugs through the aperture positioned therebetween. A projection is formed on the block near the third surface which projection fits within and substantially covers the cable passage in the second female plug. The inventive connector support block, with the male and two female electrical plugs attached, thus forms a secure "two-fer" for allowing a single electrical supply cable to be split to service two different fixtures.

OBJECTS AND ADVANTAGES OF THE INVENTION

The principle objects and advantages of the present invention include: providing a support block for multiple electrical connectors; providing such a support block which securely supports a male and two female plugs (or vice versa) in opposite facing directions; providing such a support block in which the three electrical plugs are electrically connectable via hidden wiring; providing such a support block which, when all three electrical plugs are attached and interconnected, forms an economical and rugged "two-fer" circuit splitter; providing such a support block which allows a two-fer to be constructed from readily available plugs; and providing such a support block which is economical to manufacture, efficient in operation, capable of a long and reliable operating life and which is particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 3 is a side elevational view of the support plate with a pair of female plugs and a male plug attached thereto and interconnected to form a two-fer, with hidden electrical terminals and electrical conductors shown in phantom lines.

FIG. 4 is an end elevational view of the support plate of FIG. 1, shown in conjunction with end elevational views of a male plug and a female plug positioned for connection to the support plate.

FIG. 5 is a side elevational view of the support plate of FIG. 1.

FIG. 6 is a top plan view of the support plate of FIG. 1.

DETAILED DESCRIPTION OF THE PREFERRED EMBODIMENTS

I. Introduction and Environment

Figure 1:
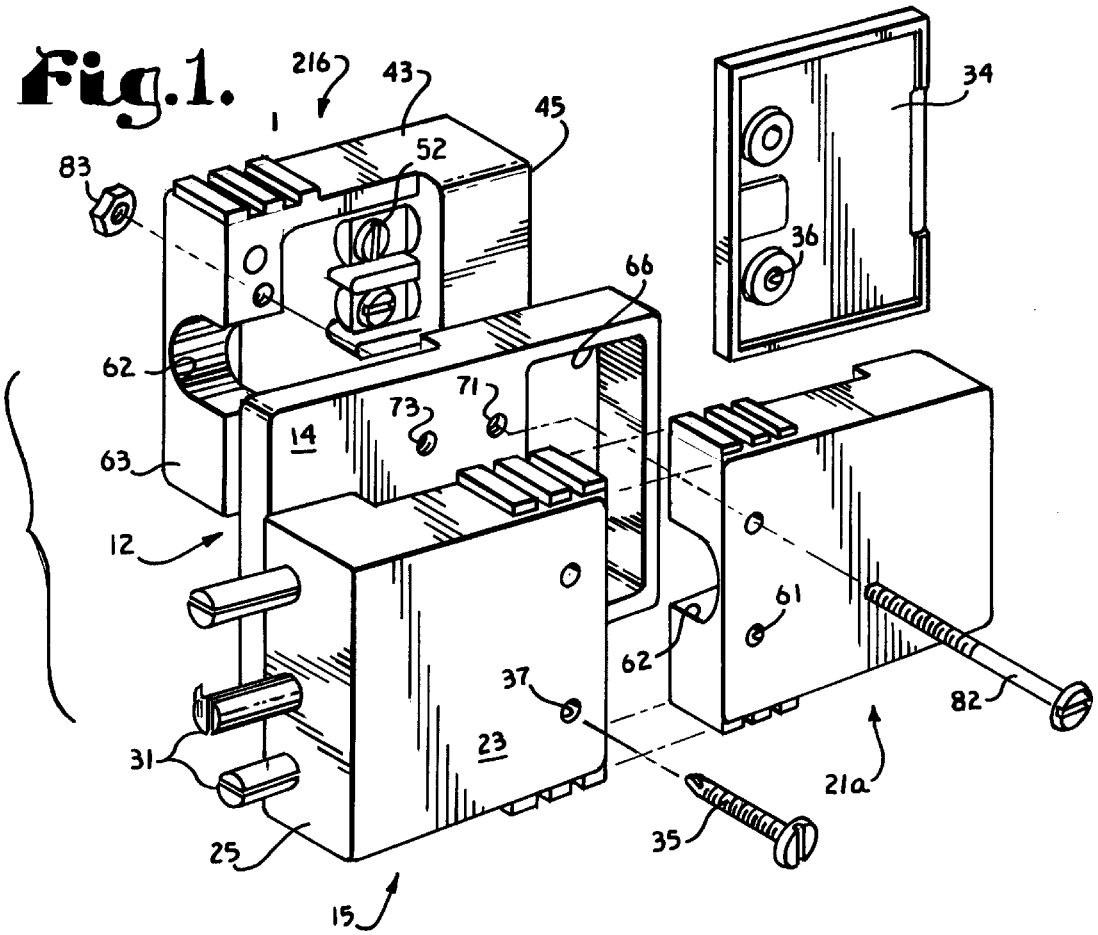
FIG. 1 is a perspective view of a support plate in accordance with the present invention shown in conjunction with three electrical plugs in an exploded view positioned for attachment to the support plate.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "up", "down", "right" and "left" will refer to directions in the drawings to which reference is made. Said terminology will include the words specifically mentioned, derivatives thereof and words of a similar import.

Figure 2:
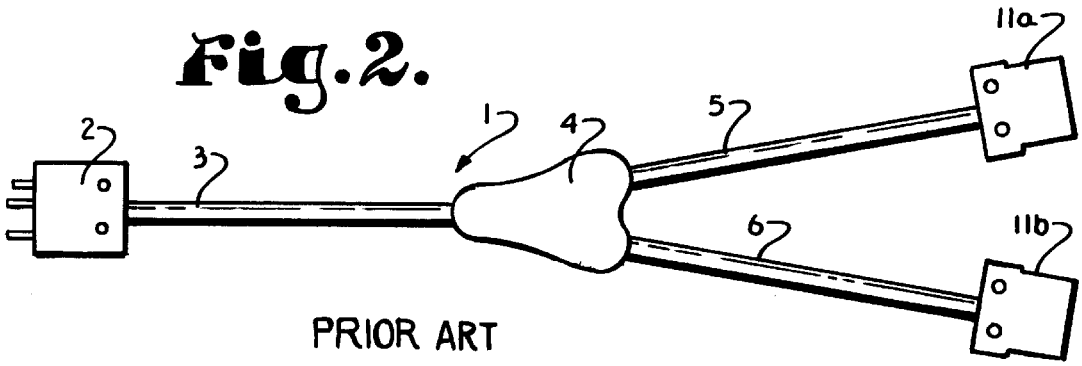
FIG. 2 is a top plan view of a prior art molded electrical circuit splitter, commonly known as a two-fer.

Referring to the drawings in more detail, reference numeral 1 in FIG. 2 generally designates a prior art two-fer with a male electrical plug 2 connected to one end of a first cable 3. A molded plastic splitter 4 connects a second end of the first cable 3 to a first end of each of a pair of cables 5 and 6 connected in parallel. A second end of each of the cables 5 and 6 terminates in a respective female electrical plug 11*a* and 11*b*. The two-fer 1 is designed to split an incoming power cable (not shown) connected to the male plug 2 into two power cables (not shown), each of which is connected to a respective one of the female plugs 11*a* and 11*b*. As mentioned earlier, the two-fer 1 is subject to failure due to open circuits and/or short circuits developing in the cables 3, 5 or 6 over a prolonged period of use in stage or theatrical productions. The cables 3, 5 and 6 can also be inadvertently severed or otherwise damaged, such as by equipment being rolled over them. Finally, the two-fer 1 is somewhat bulky and lengthy, difficult to store, and is subject to damage during storage as well.

Referring to FIGS. 1 and 3–5, the inventive support block is shown and generally indicated at 12. The support block 12, which can be integrally molded from a phenolic resin or other high impact plastic material, includes a first portion 13 as referenced in FIG. 5. The first portion 13 has a first thickness and forms a first surface 14 for holding a male electrical plug 15. The male electrical plug 15, as well as female electrical plugs 21*a* and 21*b*, are preferably of the locking type described by Wolpert in the '415 patent. The male plug 15 includes a main body 23, also formed of molded plastic, with three openings 24 extending through a front wall 25 and accommodating respective ones of three conductive prongs 31. The prongs 31 are connected to respective screw terminals 32 positioned within a cavity 33 in the main body 23.

Each of the male and female electrical plugs 15, 21*a* and 21*b* respectively includes a cover plate 34 (one of which is shown in FIG. 1 as having been generally removed from one of the plugs 15, 21*a* or 21*b*). One of the cover plates 34 is used to cover the cavity 33, with the plate 34 being attachable to the main body 23 via a plurality of screws 35 insertable through bores 36 in the cover plate 34 and extending into mating bores 37 in the main body 23. Only one cover plate 34 is shown, since cover plates for the male plug 15 and the female plugs 21*a* and 21*b* are identical. A semi-circular cable routing opening 41 is formed in a rear wall 42 of the main plug body 23 to allow for the passage of an electrical cable from the exterior to the interior of the main body 23.

Each of the female plugs 21*a* and 21*b* are of similar construction, with each including a main body 43, also formed of molded plastic, with three openings 44 (two of which are shown in phantom lines in FIG. 3) extending through a front wall 45 and accommodating respective ones of three conductive sleeves 51 (shown generally in phantom lines in FIG. 3). The sleeves 51 are connected to respective screw terminals 52 positioned within a cavity 53 in the main body 43. A cover plate 34 is provided to cover the cavity 53, with the plate 34 being attachable to the main body 43 via a plurality of screws 35 insertable through bores 36 in the cover plate 34 and into threaded bores 61 in the main body 43. A semi-circular cable routing opening 62 is formed in a rear wall 63 of the main plug body 43 to allow for the passage of an electrical cable from the exterior to the interior of the main body 43. For purposes of attachment to the support block 12, the cover plates 34 are removed from the male plug 15 and the female plugs 21*a* and 21*b*.

The support block 12 also includes a second portion 63 (as referenced in FIG. 5) with a minimum thickness approximately twice as deep as the first portion 13. The second portion 63 forms a second surface 64 and a third surface 65 for holding respective ones of the female electrical plugs 21*a* and 21*b*. A T-shaped aperture 66 (as best seen in FIG. 6) is formed in the second portion 63 and extends from the second surface 64 to the third surface 65 to allow electrical connections to be made between the pair of female plugs 21*a* and 21*b*. A pair of circular through bores 71 are also formed in the second block portion 63 with the through bores 71 positioned to match the pair of bores 61 in the female plugs 21*a* and 21*b*. A pair of bores 73 are formed in the first surface 14 of the first portion 13 with the bores 73 positioned to match the bores 37 in the male plug 15. A semi-cylindrical projection 74 extends upward from the third surface 65 of the block 12.

In order to assemble the inventive support block 12, the male plug 15 and the two female plugs 21*a* and 21*b* into an integral two-fer unit, the cover plates 34 are removed from the male plug 15 and the female plugs 21*a* and 21*b* and two of the screws 35 are retained. One end of each of three short conductors 75 (shown in phantom lines in FIG. 3) are connected to a respective one of the terminals 32 in the male plug 15. The two threaded screws 35 from the cover plate 34 are then inserted from a bottom surface 76 of the male plug 15 into the two bores 73 in the first surface 14 of the block 12 to thereby secure the male plug 15 to the first surface 14 with the three conductors 75 routed out through the semicircular opening 41 in the male plug 15. Next the second end of each of the three first conductors 75 are attached to the respective terminals 52 in a first one of the female plugs 21*a*. A first end of each of three second short conductors 81 (shown in phantom lines in FIG. 3) are also attached to respective ones of the terminals 52 in the first female plug 21*a*. The second conductors 81 are then routed through the T-shaped aperture 65 in the block 12 and a second end of each conductor 81 is connected to a respective one of the terminals 52 in the second female plug 21*b*. The first female plug 21*a* is then placed on the second surface 63 of the block 12 immediately adjacent the male plug 15 with the conductors 75 routed through the semicircular cable routing opening 62 in the first female plug 21*a*. The second female plug 21*b* is positioned on the third surface 64 of the block 12 and a pair of machine screws 82 are inserted through respective bores 61 in the first female plug 21*a*, through respective through bores 71 in the block 12 and then through respective bores 61 in the second female plug 21*b* with nuts 83 attached to the screws 82 to hold the female plugs 21*a* and 21*b* in position opposite each other. The semicircular projection 74 fills the semi-circular opening 62 in the second female plug 21*b* to yield a finished look to the resulting assembly. The support block 12 with the male plug 15 and the two female plugs 21*a* and 21*b* attached thus forms a secure, rugged splitter or two-fer which avoids many of the problems of the prior art as addressed above. A single supply cable (not shown) can thus be plugged into the male plug 15 and a respective pair of supply cables (not shown) can be plugged into the two female plugs 21*a* and 21*b*, thus allowing a single electrical supply cable to be split to service two different fixtures.

Although a single male plug 15 and a pair of female plugs 21*a* and 21*b* are illustrated and described herein, it should be recognized that two male plugs and a single female plug could be used as well. Furthermore, with slight modifications, the support block 12 could serve as a three way splitter or "three-fer" by placing an additional female plug on the side opposite the male plug 15. The inventive block 12 has been shown as shaped specifically for electrical plugs made by the Union Connector Company, which are generally rectangular in shape, however, with slight variations in shape, the block 12 can be used for other plugs, such as those made and sold by Stage Connectors, Inc., which are similar in size and operation to the Union plugs but which have a slight taper near the cable end.

It is thus to be understood that while certain forms of the present invention have been illustrated and described herein, it is not to be limited to the specific forms or arrangement of parts described and shown.

What is claimed and desired to be secured by Letters Patent is as follows:

1. A support block for positioning and supporting a first male multi-prong electrical plug extending in a first direction and a pair of female multi-socket plugs extending in a second direction opposite to said first direction, each of said plugs including a cavity with a plurality of terminals respectively connected to corresponding ones of said prongs or sockets, and a cable passage connecting from an outside surface of said plug to said cavity and sized to accommodate an electrical cable, said support block comprising:

a. a first portion including a first surface on a first side of said support block, said first surface being sized to support the male electrical plug;

b. a second portion including second and third surfaces, each sized and equipped to support respective ones of the female plugs, said second and third surfaces having a passage therebetween, said first surface and said second surface being disposed adjacent each other on said first side of said support block and said third surface being positioned on a second side of said support block immediately opposite said second surface; and c. fastening means for attaching the male electrical plug and the pair of female electrical plugs to the respective first, second and third surfaces.

2. A support block as in claim 1, and wherein said first and second surfaces are oriented such that the male plug, when attached to said first surface, and one of the female plugs, when attached to said second surface, have their cable passages aligned.

3. A support block as in claim 1, wherein said fastening means comprises:

a. a pair of bores in said first surface for receiving a respective pair of threaded screws extending though the male plug; and b. a pair of through bores extending from said second to said third surface for receiving a respective pair of screws extending through both of the female plugs.

4. A support block as in claim 1, and further comprising:

a. a projection extending upward from said third surface, said projection being sized, shaped and positioned to block off the cable passage of the female plug attached to said third surface.

5. A support block for positioning and supporting a male multi-prong electrical plug extending in a first direction and a pair of female multi-socket plugs of a second type extending in a second direction opposite to said first direction, each of the plugs including a cavity with a plurality of terminals respectively connected to corresponding ones of said prongs or sockets and a cable passage connecting from an outside surface of said plug to said cavity and sized to accommodate an electrical cable, said support block comprising:

a. a first portion including a first surface on a first side of said support block, said first surface being sized to support the male electrical plug;

b. a second portion including opposing second and third surfaces, each sized and equipped to support respective ones of the female plugs, said second and third surfaces having a passage therebetween, said first surface and said second surface being disposed adjacent each other on said first side of said support block and said third surface being positioned on a second side of said support block immediately opposite said second surface and oriented such that the male plug, when attached to said first surface, and a first one of the female plugs, when attached to said second surface, have their cable passages aligned;

c. fastening means for attaching the male electrical plug and the pair of female electrical plugs to the respective first, second and third surfaces; and d. a projection extending upward from said third surface, said projection being sized, shaped and positioned to block off the cable passage of a second one of the female plugs when it is attached to said third surface.

6. A support block as in claim 1, wherein said fastening means comprises:

a. a pair of bores in said first surface for receiving a respective pair of threaded screws extending though the male plug; and b. a pair of through bores extending from said second to said third surface for receiving a respective pair of screws extending through both of the female plugs.

7. A "two-fer" which is designed to split a three conductor electrical circuit into two common three conductor electrical circuits, said two-fer comprising:

a. a three conductor male electrical plug including three electrically conductive prongs extending outward from a first surface of a male plug housing, said male plug housing including a cavity with three terminals respectively connected to corresponding ones of said prongs and a cable passage connecting from outside said male plug housing to said cavity through a second surface of said male plug housing opposite said first surface of said male housing, said cable passage being sized to accommodate an electrical cable;

b. first and second three conductor female electrical plugs, each including three electrically conductive receptacles extending inward from a first surface of a female plug housing, each said female plug housing including a cavity with three terminals respectively connected to corresponding ones of said receptacles and a cable passage connecting from outside said female plug housing to said cavity through a second surface of said female plug housing opposite said first surface of said female housing, each said cable passage being sized to accommodate an electrical cable;

c. a support block which positions and supports said male electrical plug with said prongs extending in a first direction and said first and second female electrical plugs with their respective receptacles extending in a second direction opposite to said first direction, said support block comprising:

i. a first portion including a first surface on a first side of said support block, said first surface being sized to support said male plug housing;

ii. a second portion including second and third surfaces, each sized and equipped to support respective ones of the first and second female plugs, said second and third surfaces having a passage therebetween, said first surface and said second surface being disposed adjacent each other on said first side of said support block and said third surface being positioned on a second side of said support block immediately opposite said second surface; and d. fasteners which attach the male electrical plug and the first and second electrical plugs to the respective first, second and third surfaces.

8. A two-fer as in claim 7, and wherein said first and second surfaces of said support block are oriented such that the male plug, when attached to said first surface, and one of the female plugs, when attached to said second surface, have their cable passages aligned.

9. A two-fer as in claim 7, wherein fasteners comprise threaded screws and bolts and said support block further comprises a pair of threaded bores in said first surface of said support block for receiving a respective pair of said threaded screws extending though the male plug; and a pair of through bores extending from said second to said third surface for receiving a respective pair of said threaded bolts extending through both of the female plugs.

10. A two-fer as in claim 7, and further comprising:

a. a projection extending upward from said third surface of said support block, said projection being sized, shaped and positioned to block off the cable passage of said second female plug.

* * * * *